US008651979B2

(12) United States Patent
Chen

(10) Patent No.: US 8,651,979 B2
(45) Date of Patent: Feb. 18, 2014

(54) SPORTS TRAINING DEVICE

(75) Inventor: Chia-Jen Chen, Kaohsiung (TW)

(73) Assignee: King Chou Marine Technology Co., Ltd., Pingtung Hsien (TW)

( * ) Notice: Subject to any disclaimer, the term of this patent is extended or adjusted under 35 U.S.C. 154(b) by 0 days.

(21) Appl. No.: 13/297,237

(22) Filed: Nov. 15, 2011

(65) Prior Publication Data

US 2012/0129633 A1 May 24, 2012

(30) Foreign Application Priority Data

Nov. 18, 2010 (TW) ..... 99222361 A

(51) Int. Cl.
*A63B 69/00* (2006.01)

(52) U.S. Cl.
USPC ..... 473/435; 473/422; 473/454

(58) Field of Classification Search
USPC ..... 473/422, 421, 434, 435, 454, 478, 471; D21/705; 273/395, 396, 407
See application file for complete search history.

(56) References Cited

U.S. PATENT DOCUMENTS

| | | | | | |
|---|---|---|---|---|---|
| 4,210,326 | A * | 7/1980 | Booth et al. | ..... | 473/454 |
| 4,457,513 | A * | 7/1984 | Thompson | ..... | 473/469 |
| D279,911 | S * | 7/1985 | Thompson | ..... | D21/305 |
| 4,650,189 | A * | 3/1987 | Rajacich | ..... | 473/434 |
| 4,932,657 | A * | 6/1990 | Hailer et al. | ..... | 473/446 |
| 5,431,411 | A * | 7/1995 | Padilla | ..... | 473/416 |
| 5,549,304 | A * | 8/1996 | Davis | ..... | 273/400 |
| 5,772,537 | A * | 6/1998 | Anderson et al. | ..... | 473/435 |
| 5,807,193 | A * | 9/1998 | Talarico et al. | ..... | 473/421 |
| 5,833,234 | A * | 11/1998 | Vavala et al. | ..... | 473/434 |
| 5,938,546 | A * | 8/1999 | Caruso | ..... | 473/434 |
| 6,880,828 | B2 * | 4/2005 | Liao | ..... | 473/435 |
| 6,979,274 | B1 * | 12/2005 | Raber | ..... | 473/478 |
| 7,448,968 | B1 * | 11/2008 | Petion | ..... | 473/446 |
| 7,704,169 | B1 * | 4/2010 | Bove et al. | ..... | 473/426 |
| 2008/0067751 | A1 * | 3/2008 | Hunt | ..... | 273/396 |

* cited by examiner

*Primary Examiner* — Mitra Aryanpour
(74) *Attorney, Agent, or Firm* — DLA Piper LLP (US)

(57) ABSTRACT

A sports training device includes a base and at least one net frame assembly. The net frame assembly includes a frame mounted detachably to the base, and a net attached to and surrounded by the frame. The net includes a non-elastic mesh area, and an elastic mesh area connecting the non-elastic mesh area to the frame.

7 Claims, 4 Drawing Sheets

SPORTS TRAINING DEVICE

BACKGROUND OF THE INVENTION

1. Field of the Invention

The invention relates to a training device, and more particularly to a sports training device.

2. Description of the Related Art

To win a competition in a ball game, such as a baseball, a softball, a soccer ball, or a volleyball game, besides understanding and cooperation among players, personal skill is also very important. Thus, each person and the team must constantly practice during the non-competition period. Taking for example a pitching practice, two persons are usually needed for practice, but a pitcher may also face a wall to practice by himself/herself. However, when practicing pitching on the wall, a rebound coefficient of the ball and the bounce mode are difficult to grasp, thereby resulting in ineffective training.

SUMMARY OF THE INVENTION

Therefore, an object of the present invention is to provide a sports training device that can be easily moved to an appropriate place for quick assembly and for providing ball sports training, and that can be easily disassembled and stored when not in use to prevent damage thereof due to natural condition or vandalism when placed outdoors.

According to this invention, a sports training device includes a base and at least one net frame assembly. The net frame assembly includes a frame mounted detachably to the base, and a net attached to and surrounded by the frame. The net includes a non-elastic mesh area, and an elastic mesh area connecting the non-elastic mesh area to the frame.

The advantage of the present invention resides in that because the net frame assembly and the base are detachably connected to each other, the sports training device can be easily moved to an appropriate place for quick assembly, thereby providing training for a ball sports. When not in use, the sports training device can be easily disassembled and stored, thereby preventing damage thereof due to natural condition or vandalism when placed outdoors.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
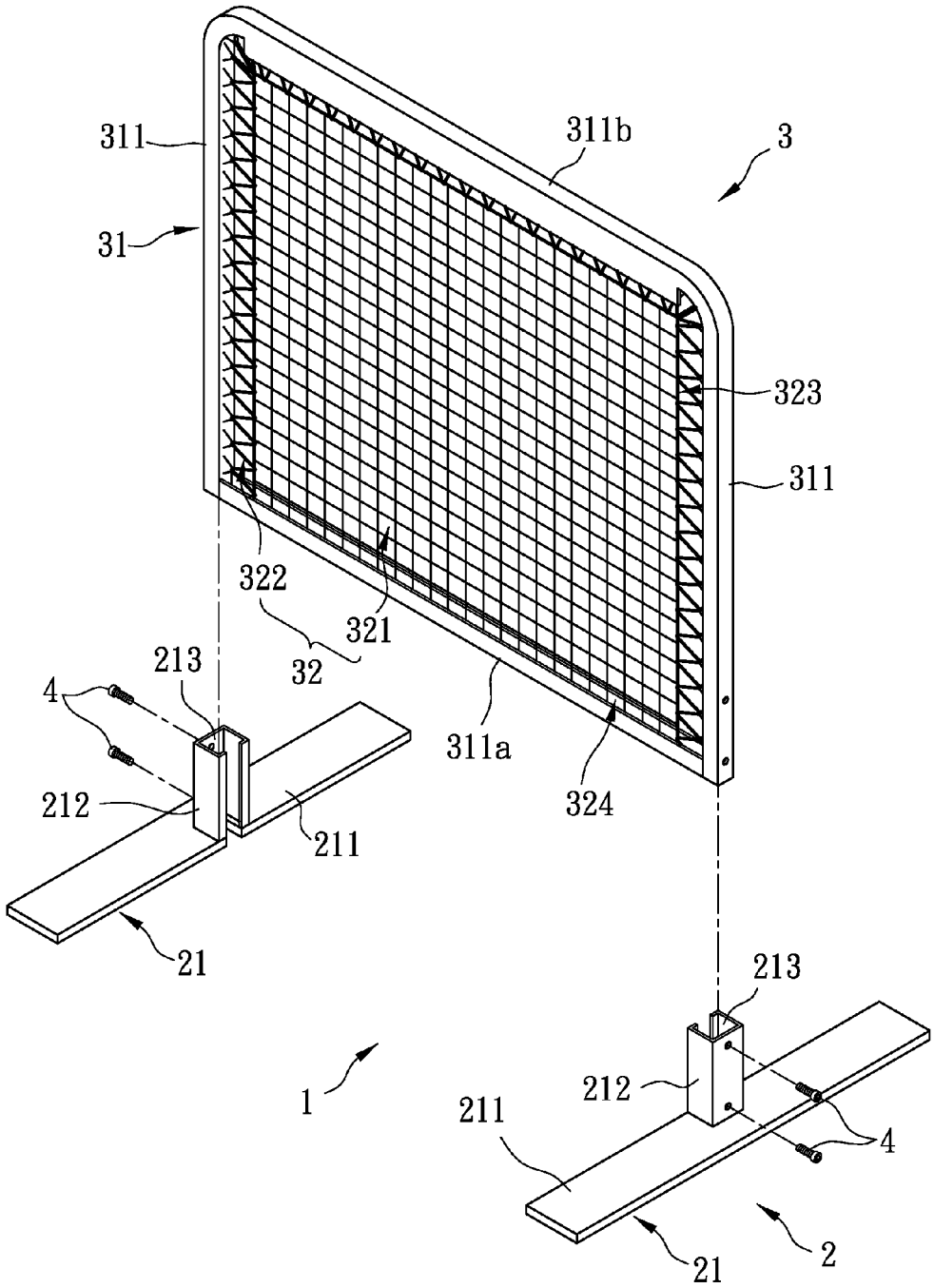
FIG. 1 is an exploded perspective view of a sports training device according to the first preferred embodiment of the present invention.

The above-mentioned and other technical contents, features, and effects of this invention will be clearly presented from the following detailed description of two embodiments in coordination with the reference drawings.

Before this invention is described in detail, it should be noted that, in the following description, similar elements are designated by the same reference numerals.

Figure 2:
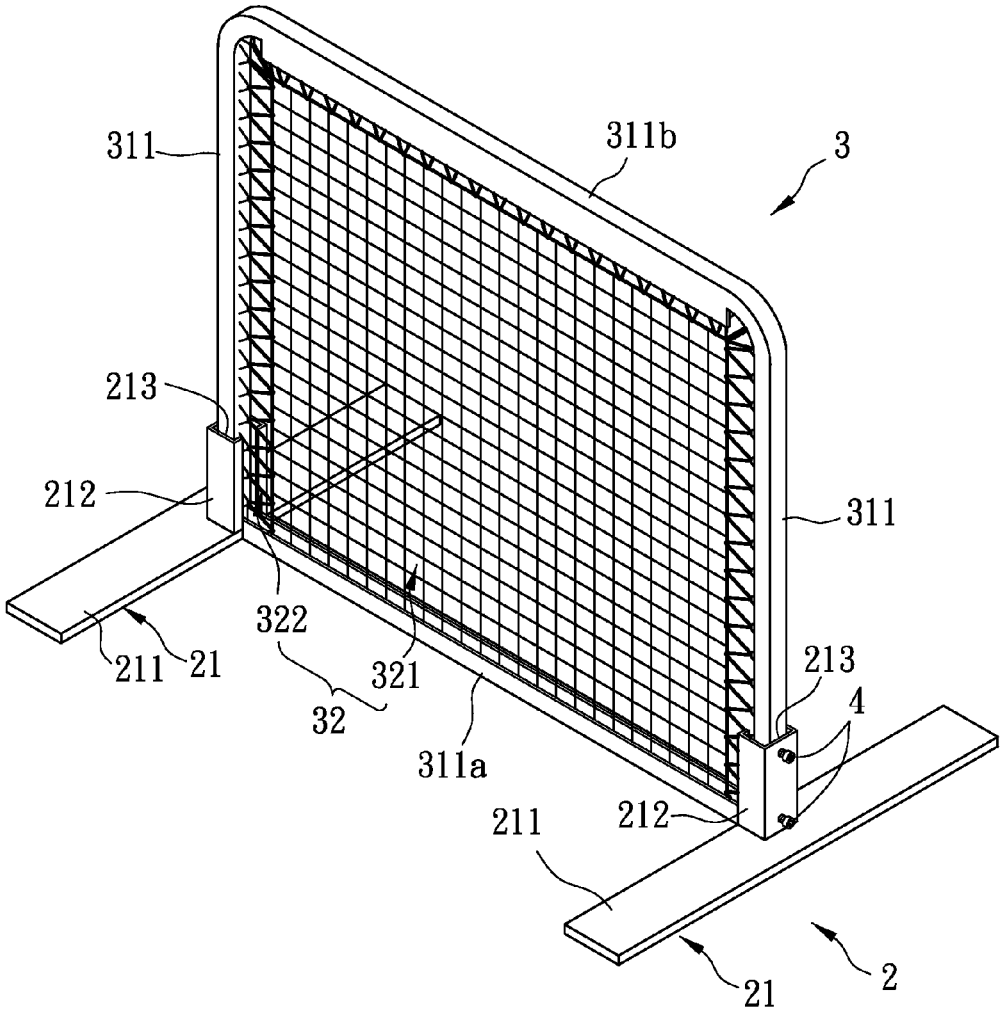
FIG. 2 is a perspective view of the first preferred embodiment in an assembled state.

Referring to FIGS. 1 and 2, a sports training device 1 according to the first preferred embodiment of the present invention is shown to comprise a base 2 and a net frame assembly 3.

The base 2 includes two spaced-apart base supports 21. Each of the base supports 21 includes a support portion 211 adapted to be disposed on the ground, and an upright portion 212 connected to the support portion 211. In this embodiment, the support portion 211 is a flat plate, but is not limited thereto. The upright portion 212 is formed with a limiting groove 213 that extends along the length thereof and that has top and bottom ends that are open. The limiting groove 213 has a substantially U-shaped cross section.

The net frame assembly 3 includes a frame 31 and a net 32. The frame 31 is mounted detachably to the base 2, and includes two side frame members 311, a bottom frame member (311*a*) and a top frame member (311*b*) that are all interconnected to define a box-shaped body. The bottom frame member (311*a*) interconnects bottom ends of the side frame members 311, and bridges the upright portions 212 of the base supports 21. The top frame member (311*b*) interconnects top ends of the side frame members 311.

The net 32 is attached to and surrounded by the frame 31. The net 32 includes a non-elastic mesh area 321 and an elastic mesh area 322. The non-elastic mesh area 321 has a first peripheral side 323 and a second peripheral side 324. The first peripheral side 323 has a substantially inverted U-shape that includes a top side and two opposite lateral sides of the non-elastic mesh area 321. The second peripheral side 324 is a bottom side of the non-elastic mesh area 321. The non-elastic mesh area 321 is connected to the elastic mesh area 322 through the first peripheral side 323. The second peripheral side 324 is connected directly to the bottom frame member (311*a*) of the frame 31. The elastic mesh area 322 interconnects the first peripheral side 323 to the top and side frame members (311*b*, 311) of the frame 31. It should be noted that the non-elastic mesh area 321 is made by weaving a non-elastic cord, and the elastic mesh area 324 is made by weaving an elastic cord.

With reference to FIGS. 1 and 2, in use, because the net frame assembly 3 and the base 2 are connected detachably to each other, a user can move the net frame assembly 3 and the base 2 to an appropriate place and then assemble the same. To assemble the net frame assembly 3 and the base 2, the side frame members 311 of the frame 31 are first inserted respectively into the limiting grooves 213 of the upright portions 212 of the base supports 21, after which a plurality of fasteners 4, in the form of screws, are used to fix the side frame members 311 to the respective upright portions 212 of the base supports 21. Hence, assembly of the net frame assembly 3 and the base 2 can be completed in a quick manner. During training of the ball sports, when a ball hits the elastic mesh area 322 of the net 32, because the elasticity of the elastic mesh area 322 is high, the ball has a high rebound. When the ball hits the non-elastic mesh area 321 of the net 32, the ball has a low rebound.

From the aforesaid description, it is apparent that since the net frame assembly 3 and the base 2 are detachably connected to each other, the net frame assembly 3 and the base 2 of the sports training device 1 can be conveniently moved by the user to an appropriate place and then assembled. After assembly, training of the ball sports can be started. When the sports training device 1 is not to be used, the net frame assembly 3 and the base 2 are disassembled and are then moved to an appropriate storage space, thereby preventing the sports training device 1 from being damaged due to rain and wind or vandalism when placed outdoors. As such, the service life of the sports training device 1 can be prolonged.

Figure 3:
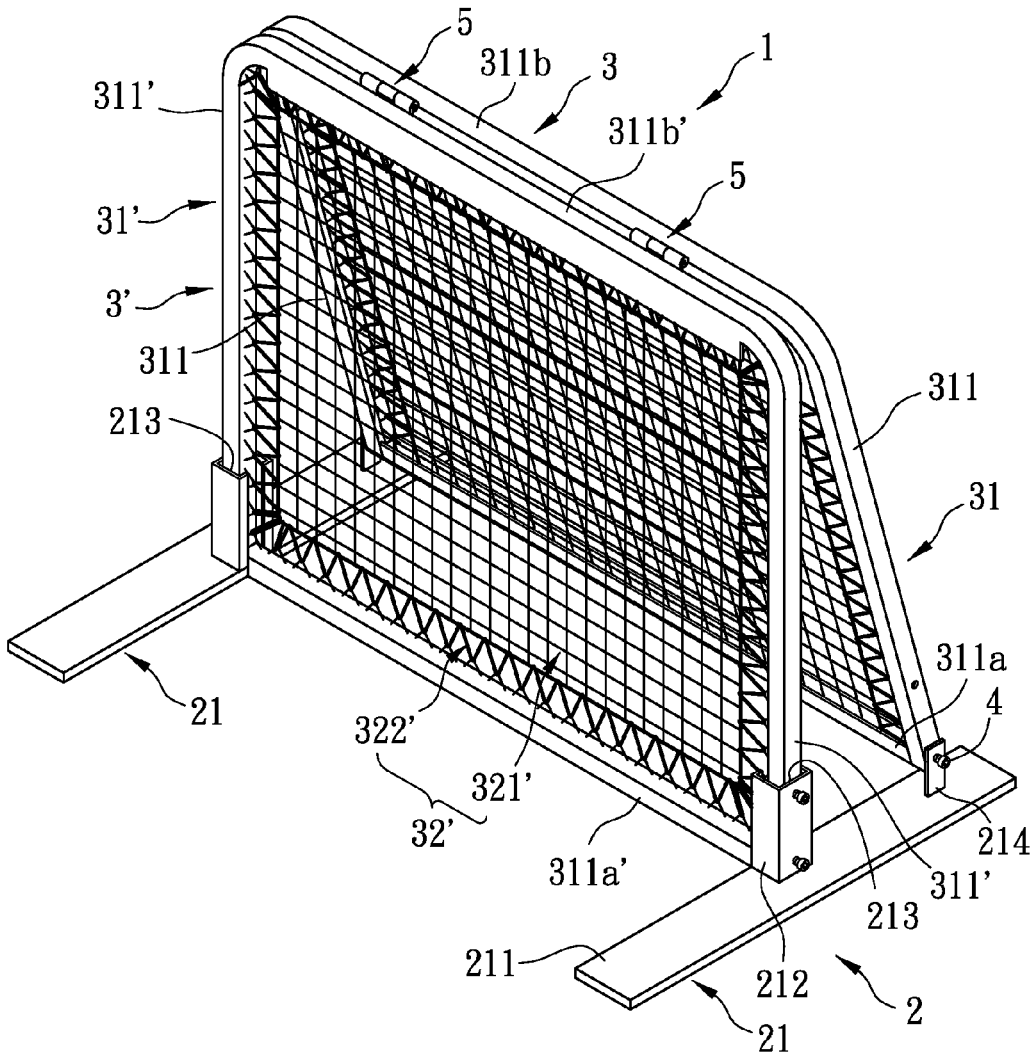
FIG. 3 is a perspective view of a sports training device according to the second preferred embodiment of the present invention.
Figure 4:
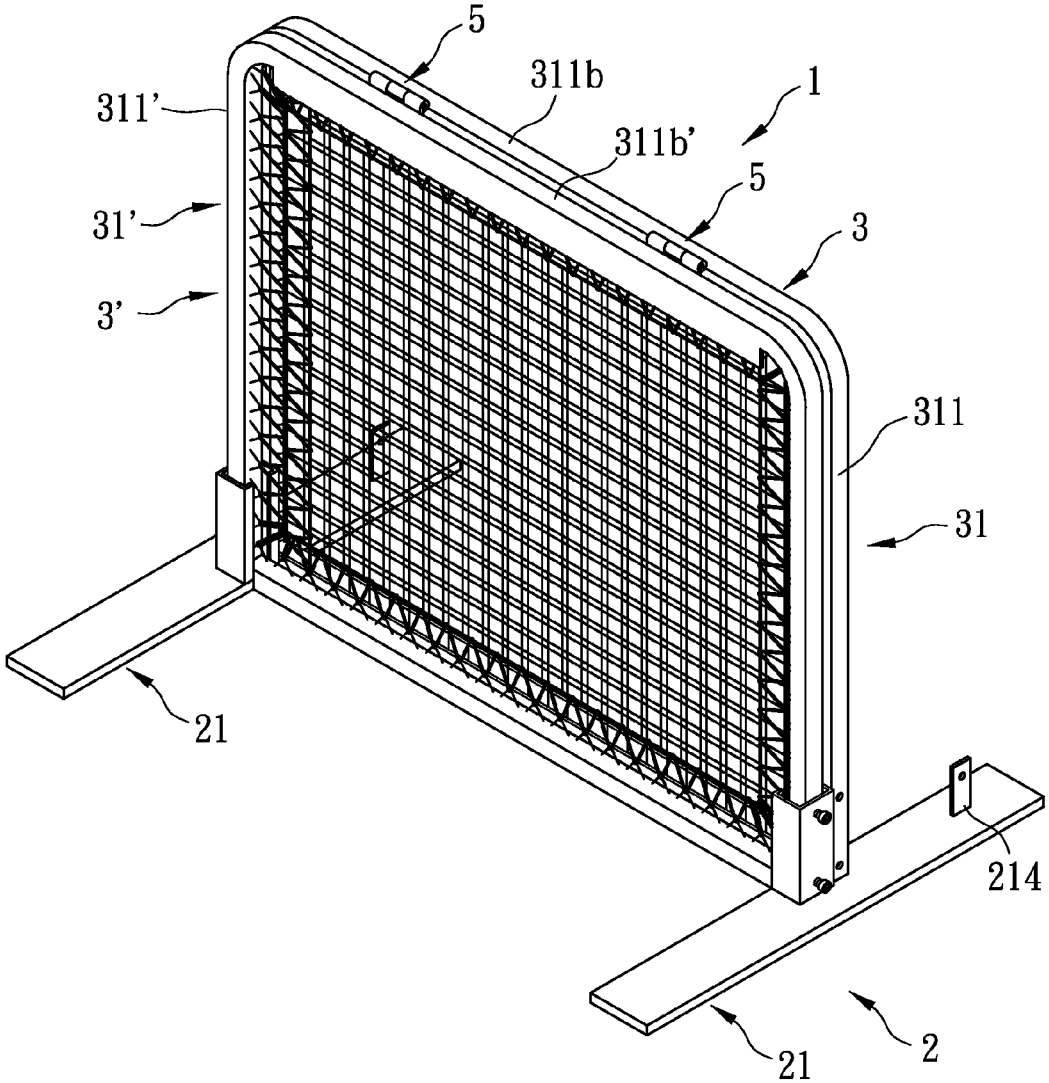
FIG. 4 is a view similar to FIG. 3, but illustrating two net frame assemblies in a folded position.

Referring to FIGS. 3 and 4, a sports training device 1 according to the second preferred embodiment of the present invention is shown to be similar to the first preferred embodiment. However, in this embodiment, the sports training device 1 comprises a pair of the net frame assemblies 3, 3'. The top frame members (311*b*, 311*b*') of the frames 31, 31' of the net frame assemblies 3, 3' are connected pivotally to each other by using a plurality of hinges 5, so that the net frame assemblies 3, 3' are movable between a folded position, as shown in FIG. 4, and an unfolded position, as shown in FIG. 3. The net 32 of the net frame assembly 3 is similar to that described in the first preferred embodiment. The elastic mesh area 322' of the net 32' of the net frame assembly 3' is connected directly to the frame 31' and the non-elastic mesh area 321'. The non-elastic mesh area 321' is surrounded entirely by the elastic mesh area 322'. Further, each of the base supports 21 of the base 2 further includes a positioning portion 214 fixed to the support portion 211 and spaced apart from the upright portion 212.

To assemble the net frame assemblies 3, 3' and the base 2 for use, the side frame members 311' of the frame 31' are first inserted respectively into the limiting grooves 213 in the upright portions 212 of the base supports 21, after which a plurality of fasteners 4, in the form of screws, are used to fix the side frame members 311' to the respective upright portions 212 of the base supports 21. The net frame assembly 3 is then pivoted relative to the net frame assembly 3' at an angle to place the net frame assemblies 3, 3' in the unfolded position. The side frame members 311 of the frame 31 are then connected removably and respectively to the positioning portions 214 of the base supports 21 using a plurality of fasteners 4. As such, different angles of rebound can be provided during training of the ball sports. When the sports training device 1 is not to be used, the fasteners 4 that fasten the side frame members 311 of the frame 31 to the positioning portions 214 are removed, after which the net frame assembly 3 is pivoted again relative to the net frame assembly 3' such that the net frame assemblies 3, 3' are superimposed one in front of the other, and are placed in the folded position. This can further save storage space. Similarly, the advantage and effect of the first preferred embodiment can be achieved using the second preferred embodiment.

It is worth mentioning that the connection of the elastic mesh area 322, 322' and the non-elastic mesh area 321, 321' of the net 32, 32' of the net frame assembly 3, 3' is not limited to the aforesaid disclosures. For example, the elastic mesh area 322, 322' may be connected between the frame 31, 31' and one of two opposite sides of the non-elastic mesh area 321, 321', and the other two opposite sides of the non-elastic mesh area 321, 321' may be connected directly to the frame 31, 31'.

In summary, because the design of the net frame assembly 3, 3' and the base 2 is detachable from each other, the environment for using the sports training device 1 of the present invention is not limited, and the sports training device 1 can be moved to an appropriate place for quick assembly to thereby facilitate training of the ball sports. Further, through the hinge connection of the two net frame assemblies 3, 3', different angles of rebound can be provided during training of the ball sports. Moreover, when not in use, the sports training device 1 can be disassembled and stored, thereby preventing the sports training device 1 from being damaged due to rain and wind or vandalism when placed outdoors. As such, the service life of the sports training device 1 can be prolonged. Hence, the object of the present invention can be realized.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A sports training device comprising:

a base;

at least one net frame assembly including a frame mounted detachably to said base and including two spaced-apart side frame members, a bottom frame member interconnecting bottom ends of said side frame members, and a top frame member interconnecting top ends of said side frame members; and a net including a non-elastic mesh area having a first peripheral side, and an elastic mesh area connecting said first peripheral side to said top and side frame members of said frame;

wherein said non-elastic mesh area further has a second peripheral side connected directly to said bottom frame member of said frame.

2. The sports training device of claim 1, wherein said base includes two spaced-apart base supports, each of said base supports having a limiting groove, said frame bridging said base supports and including two spaced-apart side frame members inserted into said limiting grooves of said base supports, respectively.

3. The sports training device of claim 2, wherein each of said base supports includes a support portion adapted to be disposed on the ground, and an upright portion connected to said support portion and having said limiting groove, said frame further including a bottom frame member inter-connecting said side frame members and bridging said upright portions of said base supports.

4. The sports training device of claim 3, further comprising a plurality of fasteners to fix said side frame members of said frame to said upright portions of said base supports.

5. The sports training device of claim 3, wherein said at least One net frame assembly includes a pair of net frame assemblies, said top frame members of each said frames of said net frame assemblies being hinged to each other, said net frame assemblies being movable between folded and unfolded positions.

6. The sports training device of claim 5, wherein each of said base supports further includes a positioning portion fixed to said support portion and spaced apart from said upright portion, said side frame members of said frame of one of said net frame assemblies being connected removably and respectively to said positioning portions of said base supports when said net frame assemblies are in said unfolded position.

7. The sports training device of claim 1, wherein said non-elastic mesh area is made by weaving a non-elastic cord, and said elastic mesh area is made by weaving an elastic cord.

* * * * *